United States Patent [19]

Kraus

[11] Patent Number: 4,763,713

[45] Date of Patent: Aug. 16, 1988

[54] MULTI-PURPOSE WINDOW SHADE

[76] Inventor: Robert J. Kraus, 155 Minot St., Boston, Mass. 02122

[21] Appl. No.: 901,935

[22] Filed: Aug. 29, 1986

[51] Int. Cl.[4] ..... E06B 9/327

[52] U.S. Cl. ..... 160/172; 160/178.3; 160/84.1

[58] Field of Search ..... 160/84 R, 166 R, 175, 160/172, 236, 32, 33, 35, 36, 178 D, 178 E, 178 F; 49/74

[56] References Cited

U.S. PATENT DOCUMENTS

| | | | |
|---|---|---|---|
| 317,798 | 5/1885 | Keller | 49/74 |
| 2,056,823 | 10/1936 | Brown | 160/133 |
| 2,061,548 | 11/1936 | Cameron | 160/178 E |
| 2,103,271 | 12/1937 | Pratt | 160/236 |
| 2,200,143 | 5/1940 | Wolfe | 160/178 E |
| 2,748,048 | 5/1956 | Russell | 160/236 |
| 2,923,350 | 2/1960 | Brown | 160/166 R |
| 2,957,520 | 10/1960 | Howard | 160/172 X |
| 2,994,370 | 8/1961 | Pinto | 160/236 X |
| 3,031,013 | 4/1962 | Russell | 160/236 X |
| 3,484,990 | 12/1969 | Kahn et al. | 160/236 X |
| 3,651,852 | 3/1972 | Neri | 160/172 |
| 4,154,281 | 5/1979 | Schluep | 160/178 E X |
| 4,397,347 | 8/1983 | Brabant | 160/84 R X |
| 4,588,223 | 5/1986 | Ledenyi | 160/84 R X |

*Primary Examiner*—Ramon S. Britts
*Assistant Examiner*—David M. Purol
*Attorney, Agent, or Firm*—Fleit, Jacobson, Cohn & Price

[57] ABSTRACT

Flexible slats rigidified by coiled formations along the longitudinal edges are hingedly interconnected by interleaving of the coiled formations to form a continous, foldable window shade, or are interconnected by flexible spacers at the ends for simultaneous pivotal displacement as shutter blinds by an actuator device hingedly connected to the coiled edge formations. An intermediate bar formation integral with each slat, has pivot extensions projecting from each end of the slat into vertical guide tracks for pivotal support.

2 Claims, 2 Drawing Sheets

MULTI-PURPOSE WINDOW SHADE

BACKGROUND OF THE INVENTION

This invention relates generally to window shade constructions and in particular, to window shades formed by elongated, flexible slats.

The use of slats assembled to form window shades, screens and other protective covers is well known. There are generally two distinct types of window shades or screens in which pivotal and vertical adjustments are made relative to vertical guide tracks. A continuous shade or screen cover that is foldably contracted in a vertical direction between the guide tracks is one well known type as disclosed for example in U.S. Pat. Nos. 4,202,395 and 4,535,828. The other well known type involves an adjustable shutter or venetian blind in which separate slats are used. The construction of such blind or shutter slats is shown, for example, in U.S. Pat. No. 4,470,444.

Window shades or screens of the foregoing types are often of costly construction, require complex assembly and installation and are difficult to repair and/or service. Further, marketing of such window shade assemblies has not been as successful as possible because of a lack of flexibility in meeting installational requirements and diverse consumer demands.

It is therefore an important object of the present invention to provide a slat construction for window shade assemblies which is less costly without qualitive sacrifice and more flexible in its assembly and installation as compared to prior art constructions.

Another object of the invention is to provide a window shade assembly which may be readily tailored to meet diverse consumer demands in an efficient manner.

Yet another object of the invention it to provide a window shade assembly that is easily assembled, serviced and repaired by partial parts replacement.

SUMMARY OF THE INVENTION

In accordance with the present invention, window shades are formed by an assembly of identical slats having a unique construction by reason of which the slats exhibit an unexpectedly beneficial balance between flexibility and rigidity for alternative use in a continuous, foldable shade arrangement, in an adjustable shutter or venetian blind arrangement, or in various hybrid arrangements involving both continuous, foldable sections and adjustable shutter sections. The different adjustable slat arrangements are established by interconnections independent of the supporting frame assembly, as hereinafter described.

Each slat may be extruded in one piece from a flexible type of plastic material of generally elongated rectangular shape having a uniform sheet thickness except for integral rigidifying formations extending in parallel spaced relation along substantially the entire opposite longitudinal edges of the slat and a central intermediate portion of the slat. The intermediate rigidifying formation is in the form of a cross-sectionally circular bar of a diameter greater than the otherwise uniform thickness of the slat. The bar projects axially beyond the opposite ends of the slat to form pivot shaft extensions slidably received in vertical guide tracks fixedly mounted on the side frames of a window opening, for example. The slat is thereby mounted for vertically slidable adjustment relative to the guide tracks and angular adjustment about a central pivot axis through the intermediate bar formation and pivot shaft extensions thereof.

The rigidifying formations along the edges of the slat are in the form of cross-sectionally coiled sheet extensions of the slat which not only serve to provide rigidity, but also optionally establish hinge connections to adjacent slats by being interleaved with the coil extensions thereof. When hingedly interconnected, the slats form a continuous, foldable shade cover as shown per se in U.S. Pat. No. 2,099,408, by way of example. The prior art as exemplified by such patent does not however contain any suggestion for structurally independent use of the slats in which the coiled edge portions cooperate with an intermediate bar formation to provide the necessary rigidity in a shutter type of arrangement in accordance with the present invention.

The vertical guide tracks which slidably receive the pivot shaft extensions of the intermediate bar formations of the slats, are provided with stop extensions projecting in longitudinally overlapping relation to the slats at the end portions so as to limit angular displacement thereof about the pivot shaft extensions. The ends of the slats on one radial side of the pivot shaft extensions are notched adjacent to the bar formation and the edge so as to accommodate angular displacement by at least 180° between substantially horizontal and vertical positions.

One or more of the slats such as the lowermost slat, is provided with hemispherical detent elements on the ends of the pivot shaft extensions for projection into spaced, dimple recesses formed in the web surface of the guide track channel. The slat is thereby yieldably held at vertically spaced positions along the track channel during adjustment from which it is released for displacement in response to longitudinal bending by a small amount.

The slats used in a shutter arrangement are interconnected in vertically spaced relation by flexible spacer elements pivotally connected to the pivot shaft extensions between the end portions. The slats are also pivotally interconnected along the edge formations intermediate the end portions by a flexible actuator device. The slats are thereby manually adjusted by simultaneous pivotal displacement in the same direction.

BRIEF DESCRIPTION OF THE DRAWINGS

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
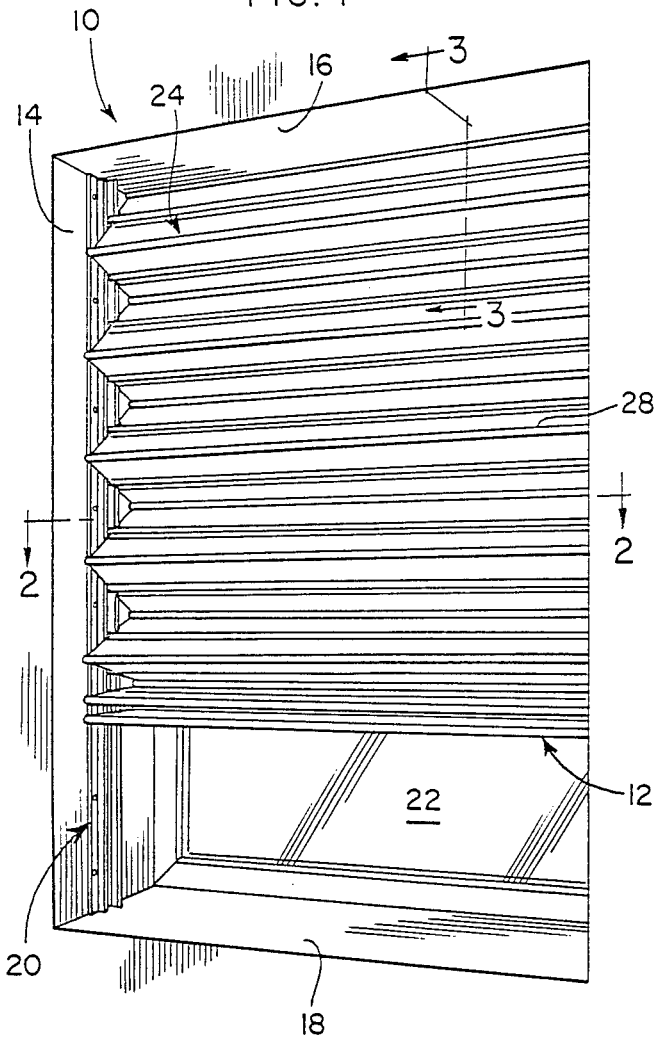
FIG. 1 is a perspective view of a window shade installation in accordance with one embodiment of the invention, of the continuous foldable shade type.
Figure 3:
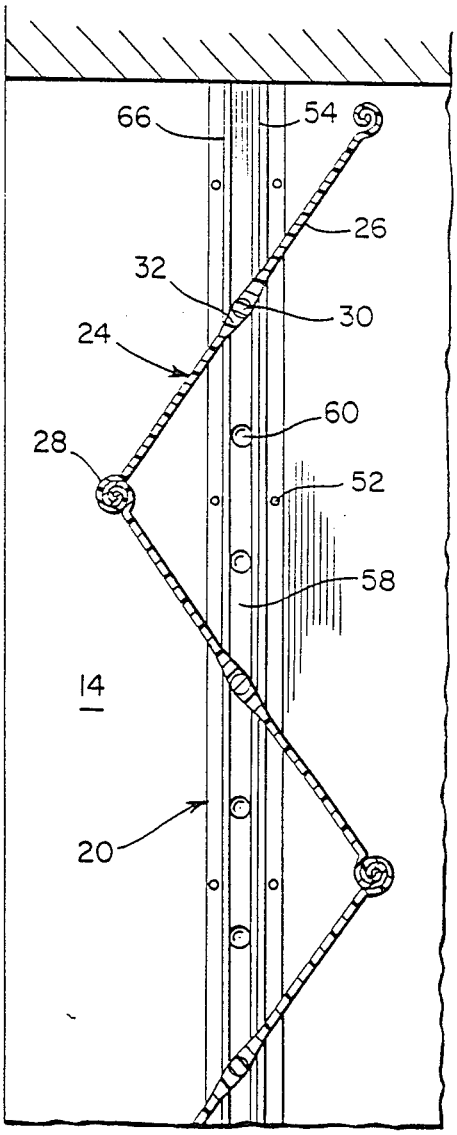
FIG. 3 is an enlarged partial section view taken substantially through a plane indicated by section line 3—3 in FIG. 1.
Figure 2:
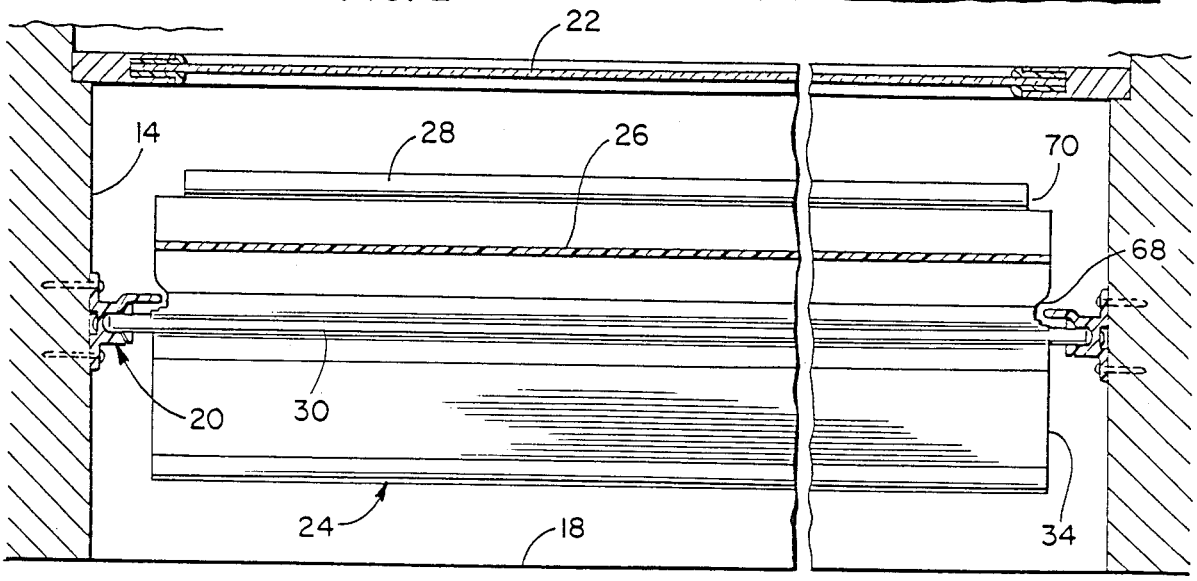
FIG. 2 is an enlarged partial top section view taken substantially through a plane indicated by section line 2—2 in FIG. 1.

Referring now to the drawings in detail, FIGS. 1, 2 and 3 illustrate a window shade installation of the continuous foldable type generally denoted by reference numeral 10. The installation 10 includes a window shade assembly generally referred to by reference numeral 12 mounted within a window opening formed by side frame members 14, a top frame member 16 and a sill 18. A confronting pair of vertical track guide members 20 are fixably mounted on the side frame members 14 of the window opening frame in order to adjustably support the shade assembly 12 on the inside of a building in close rearwardly spaced relation to the window 22.

The window shade assembly 12 is formed by a plurality of identical slat elements generally referred to by reference numeral 24. The slats 24 are hingedly interconnected along parallel hinge axes so as to form a continuous, foldable shade in the embodiment shown in FIGS. 1, 2, and 3. The shade assembly is supported by the vertical guide tracks 20 by virtue of a slidable and pivotal connection with each individual slat 24.

Each slat element 24 is preferably extruded from a plastic material in one piece and has a generally elongated rectangular shape. The major body portion 26 of each slat is of a substantially uniform thickness of a dimension characteristic of a relatively flexible sheet. Parallel spaced rigidifying formations 28 are formed along the substantially entire longitudinal edges of each slat in the form of coiled extensions of the sheet like body portion 26. An intermediate rigidifying formation in the form of a cross-sectionally circular bar is also integrally formed with the slat equally spaced between the coiled edge formations 28. The bar formation 30 has a diameter greater than that of the uniform thickness of the slat body portions 26 and is interconnected therewith by transition portions 32 converging from the bar formation 30 in opposite radial directions toward the body portions 26. In the embodiment shown in FIGS. 1, 2 and 3, hinge connections are established between adjacent longitudinal formations 28 of the slats 24 by interleaving of the coils as shown in FIG. 3.

Figure 4:
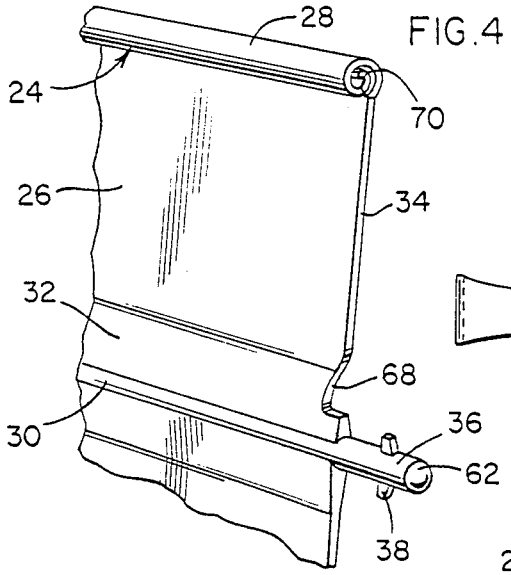
FIG. 4 is a partial perspective view of one of the slats associated with the window shade constructions in accordance with the present invention.

As shown in FIGS. 2 and 4, the rigidifying bar formation 30 of each slat projects axially beyond the opposite ends of the slat to form pivotal shaft extensions 36 which are slidably and pivotally received within the vertical guide tracks 20. Tapered stop elements 38 project radially from opposite sides of each pivot shaft extension 36 as more clearly seen in FIG. 4 for purposes to be indicated hereinafter.

Figure 5:
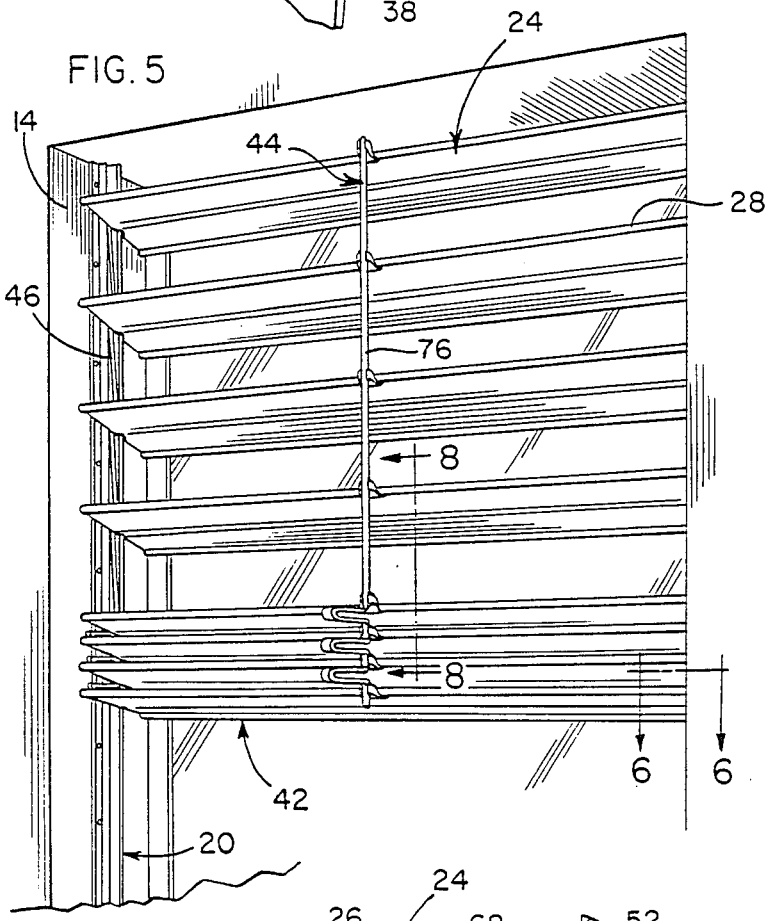
FIG. 5 is a partial perspective view of a window shade installation in accordance with another embodiment of the present invention, of the adjustable shutter type.

FIG. 5 illustrates another embodiment of the invention in which an adjustable shutter type of window shade assembly 42 is formed by the same slats 24. The adjustable shutter type of shade assembly is shown mounted within the same window frame opening by the same vertical guide tracks 20 as indicated with respect to FIG. 1. The slats 24 associated with the shutter type window shade assembly 42 are of course structurally independent of each other but are angularly adjusted simultaneously in the same direction through an actuator device generally referred to by reference numeral 44. The individual slats 24 are pivotally and slidably received within the vertical guide tracks 20 as in the case of the slats 24 associated with the window shade assembly 12 shown in FIG. 1. However, in the adjustable shutter type embodiment shown in FIG. 5, the slats 24 are interconnected in vertically spaced relationship to each other by both the actuator device 44 located intermediate the ends of the slats and flexible spacer elements 46 as more clearly shown in FIG. 7. The spacer elements are interconnected at opposite ends thereof by enlargements 48 through which the pivot extensions 36 extend.

Figure 6:
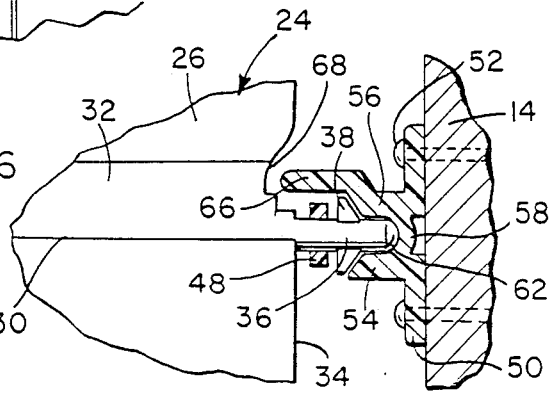
FIG. 6 is an enlarged partial section view taken substantially through a plane indicated by section line 6—6 in FIG. 5.

Referring now to FIG. 6 in particular, each of the vertical guide tracks 20 may be formed from an extruded plastic material dimensioned so as to be relatively rigid as compared to the slats. The guide track includes a pair of flanges 50 abutting the side frame 14 to which they may be secured by fasteners 52 for example. Parallel spaced legs 54 and 56 project from the flanges 50 to form therebetween a guide channel into which the pivot shaft extensions 36 extend. The web portion 58 of the guide channel is formed with vertically spaced dimple recesses 60 adapted to receive and cooperate with hemispherical detent formations 62 projecting from the axial ends of the pivot shaft extensions 36 associated with the lowermost slat of the shade assembly. Thus, the lowermost slat of a shade assembly may be yieldably held in a desired vertical position as shown by way of example in FIGS. 1 and 5 whereas the other slats will be more readily displaceable in a vertical direction. Each of the slats will of course also be pivotally displaceable about its shaft extensions 36 either in response to folding or unfolding of the continuous shade assembly 12 or in response to angular adjustment of the slats as shutters of a venetian blind through the actuator device 44 shown in FIG. 5.

Figure 6A:
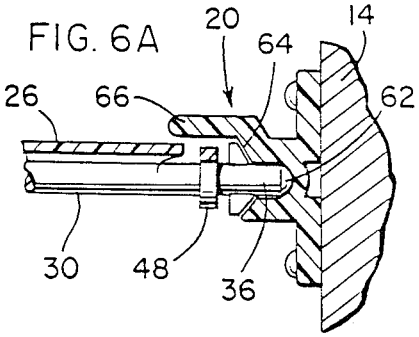
FIG. 6*a* is a section view similar to FIG. 6 showing the shutter slat displaced from the position shown in FIG. 6.

With continued reference to FIG. 6, the projection of the pivot shaft extensions 36 into the guide channel between legs 54 and 56 is limited by abutment of the stop elements 38 with conical surfaces 64 formed at the receiving ends of the channel legs 54 and 56. The enlarged end portions 48 of two spacer elements 46 are connected to each shaft extension 36 as aforementioned between the stop elements 38 and the longitudinal end 34 of the slat. A lateral stop projection 66 extends from the leg portion 56 of the guide track in parallel spaced relationship to the pivot shaft extensions 36, overlapping the end portions of the slats 24. Accordingly, the stop projection 66 will limit angular displacement of the slats about their pivot shaft extensions 36. In order to accommodate pivotal displacement of the slats by at least 180°, each of the slats on one radial side of the intermediate bar formation 30 is provided with a notch 68 adjacent the bar formation 30 and a notch 70 at the edge of the slat to thereby terminate the coiled formation 28 in close spaced relationship to the end 34 of the slat as more clearly seen in FIG. 4. Thus, it will be apparent that only the radial side of the slat opposite the notched side will abut the stop projection 66 to limit angular displacement of the slat as will be evident from FIG. 6*a* showing the slat 24 angularly displaced to a substantially vertical position as compared to the horizontal position shown in FIG. 6.

Figure 9:
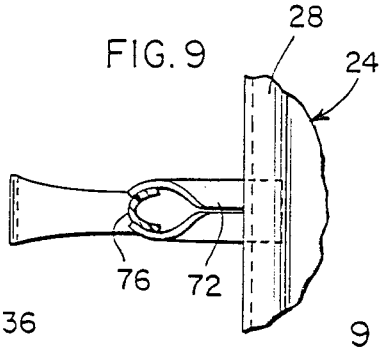
FIG. 9 is a top section view taken substantially through a plane indicated by section line 9—9 in FIG. 8.
Figure 8:
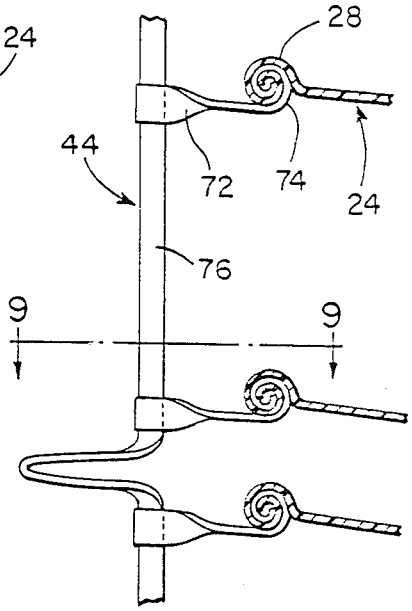
FIG. 8 is an enlarged partial section view taken substantially through a plane indicated by section line 8—8 in FIG. 5.
Figure 7:
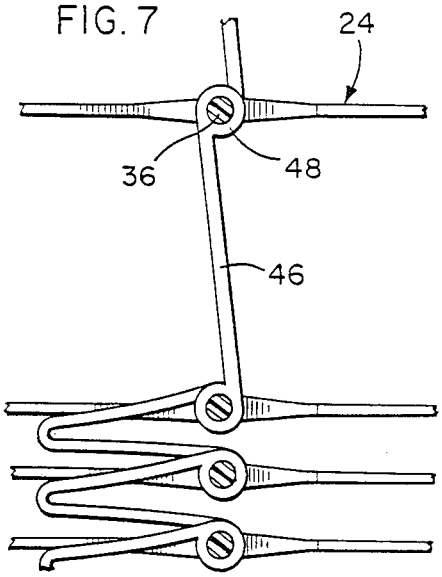
FIG. 7 is a partial end view of the shutter slats interconnected in accordance with the embodiment depicted in FIG. 5.

The actuator device 44 referred to in connection with FIG. 5, is shown in greater detail in FIGS. 8 and 9. One of the coiled formations 28 of each slat is hingedly connected to the actuator device 44 about the hinge axis extending through the formation 28, by means of a pair of flexible straps 72 having coiled ends 74 interleaved with the coil formation 28 of the slat. The straps 72 extend from the coiled edge formation 28 of each slat and are twisted a quarter turn so as to be secured by adhesive or the like to opposite longitudinal portions of an elongated flexible tape 76 maintained thereby cross-sectionally curved in a plane generally parallel to the hinge axis. The straps 72 and tape 76 may be made of the same flexible plastic. The tape 72, as in the case of the flexible spacer elements 46, may flex or buckle as shown in FIGS. 7 and 8 in order to accommodate reduced spacing between some of the slats. Simultaneous angular adjustment of the shutter slats 24 in the same direction may therefore be effected by pushing or pulling on the tape 76 of the actuator device in a vertical direction. The physical interrelationship between the tape 76 and the straps 72 is such as to maintain the cross-sectional curvature of the tape 76 to endow it with sufficient rigidity for transmittal of a vertical adjustment force manually applied. Nevertheless, the tape 76 maintains sufficient flexibility to accommodate its buckling as shown in FIGS. 5 and 8.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling with in the scope of the invention.

What is claimed is:

1. In a window shade assembly formed by a plurality of shutter slats having coiled edge formations, actuator means for simultaneously rotating the slats in the same direction, comprising an elongated flexible tape, a pair of flexible straps interleaved with one of the edge formations of each of the slats, means for securing each pair of the straps to the tape in a cross-sectionally curved condition and a hinge connection established between each pair of the straps and the coiled edge formation interleaved therewith along a hinge axis, said straps having quarter-turn twists maintaining the tape cross-sectionally curved in a plane generally parallel to the hinge axis.

2. In combination with a window frame having spaced vertical frame members and guide tracks mounted thereon, a window shade assembly including a plurality of elongated flexible slats having opposite end portions and spaced longitudinal edges extending therebetween, pivot means projecting from the end portions into the guide tracks for pivotal and slidable displacement of the slats relative to the guide tracks to adjusted positions, detent means in the guide tracks engageable with the pivot means of at least one of the slats for yieldable holding thereof at a vertically adjusted location between the frame members and flexible means interconnecting the slats independently of the frame members and the guide tracks for maintaining the slats in said adjusted positions relative to said one of the slats at the vertically adjusted location thereof, said flexible interconnecting means including rigidifying formations along the edges of the slats through which the slats are interconnected and actuator means pivotally connected to the rigidifying formations along the edges of the slats for selectively effecting said pivotal displacement thereof simultaneously to the adjusted positions, said actuator means comprising an elongated flexible tape, a pair of flexible straps pivotally connected to one of the rigidifying edge formations of each of the slats, and means securing each pair of the straps to the tape for maintaining the same in a cross-sectionally curved shape, said rigidifying edge formations being cross-sectionally coiled extensions of the slats, said straps being interleaved with the coil extensions.

* * * * *